United States Patent [19]

Baur

[11] 4,265,503

[45] May 5, 1981

[54] AIRCRAFT/PYLON MULTI-CONTACT ELECTRICAL CONNECTOR

[75] Inventor: Robert Baur, Los Angeles, Calif.

[73] Assignee: Automation Industries, Inc., Greenwich, Conn.

[21] Appl. No.: 105,513

[22] Filed: Dec. 20, 1979

[51] Int. Cl.[3] ..... H01R 13/62

[52] U.S. Cl. ..... 339/45 M; 339/91 R; 339/113 R

[58] Field of Search ..... 339/45 R, 45 M, 91 R, 339/113 R

[56] References Cited

U.S. PATENT DOCUMENTS

| | | | |
|---|---|---|---|
| 3,119,645 | 1/1964 | Abbott et al. | 339/45 M |
| 3,452,316 | 6/1969 | Panek et al. | 339/45 M |
| 3,594,694 | 7/1971 | Clark | 339/45 M |

*Primary Examiner*—Neil Abrams

*Attorney, Agent, or Firm*—Francis N. Carten

[57] ABSTRACT

The invention is directed to an electrical connector with multi-pin/socket contacts suitable for use in locations where the receptacle assembly is attached to a support, such as the underside of an aircraft wing, and the plug assembly is mounted on a separate detachable structure, such as a pylon. The plug assembly engages the receptacle through collet fingertips. A separate, but not independent, capsule assembly is mated with the receptacle socket contacts by vertical movement imparted by a cam assembly. The mated/engaged connector is locked in that relation by balls juxtaposed between a capsule assembly channel and a plug housing sleeve. The plug housing is suitably floated on spring loaded mounts attached to the pylon skin. The connector is unmated, unlocked and disengaged when movement of the pylon skin depresses trip ears on the plug housing; the ears depress the outer locking sleeve to release the ball-lock and to permit spring action to unmate the receptacle/plug contacts; spring action then further depresses the outer locking shell so that the fingertips release the receptacle and the plug assembly is free and ready for another engagement/mating. A retractable button signals a no mate relation except when the connector is fully mated and locked.

6 Claims, 19 Drawing Figures

AIRCRAFT/PYLON MULTI-CONTACT ELECTRICAL CONNECTOR

BACKGROUND OF THE INVENTION

1. Field of the Invention

This invention relates to multi-contact electrical connectors. More particularly, the invention relates to electrical connectors wherein the plug/receptacle shells are self-aligning and locking and the plug/socket electrical contacts are blind mating. Also, the invention relates to electrical connectors which automatically, e. g., motor driven, engage/mate, and unmate/disengage/recock.

2. Description of the Prior Art

It is known to combine in a multi-contact electrical connector a receptacle shell and a plug shell which engage (lock or interfit); plug/socket electrical contacts aided by physical means such as a cam mechanism; and have quick unmating and disengaging means. U.S. Pat. No. 3,119,645, dated Jan. 28, 1964 to J. R. Abbott, J. J. Phillips, and R. C. Stephenson, assigned to G&H Technology, Inc., discloses a connector for use between a rocket vehicle and a ground station at the time of launch.

OBJECTS

There must be an electrical connection between a pylon installed under a wing or the fuselage of an aircraft and the aircraft itself, when the pylon includes instrumentation. Normally, the pylon is removable and sometimes it is necessary to drop (jettison) the pylon in flight. Therefore, the electrical connector must be capable of automatically unmating and disengaging the plug and receptacle portions. Desirably, the shell engaging means should automatically recock, ready for the next engagement.

Also when the pylon is being attached to the wing or fuselage, the electrical connector automatically should align and engage the receptacle shell, which is mounted in the wind or fuselage, and the plug shell which is in the pylon.

Normally, more than one pylon is mounted to a wing, inboard and outboard. The aircraft wing tapers toward the tip, causing a difference in shell engagement stroke at the inboard and outboard stations, a longer stroke at the outboard station. For maximum utility the electrical connector must be capable of use at either the inboard or the outboard station.

As little physical force as possible is desired to be imposed on the wing by the connector shell engagement/disengagement and especially by the plug/socket mating/unmating, where several hundred foot pounds of force may be needed to mate a 100 contact plug/socket assembly. A typical specification upper limit on such external force applied to the wing is 50 lbs.

It is desirable that the plug/socket contacts be mated "blind" and that some visual/tactile indicator should be present to attest to the fully mated condition. Also, after reaching the mated condition, it is desirable that the inadvertent unmating of the connector by way of the mating mechanism be more or less impossible.

It would be advantageous to have the capsule assembly which includes the electrical plug inserts be sufficiently independent of the plug shell to permit removal of the capsule assembly for inspection, repair or replacement of plugs and other members, while the plug housing remains affixed to the pylon.

It would be advantageous to have the connector completely automatic in operation, both in engagement-/mating and in unmating/disengagement, for example, the forces needed to engage, etc and to unmate, etc would be provided by a motor in response to commands, individual or preprogrammed.

It will be evident from the detailed description of the preferred embodiment that these and other objects have been attained by the electrical connector of the invention.

BRIEF DESCRIPTION OF THE DRAWINGS

FIG.2 shows a side view of the receptacle shell including the flange plate for mounting the receptacle assembly to a support. FIG. 3 shows a front plan view of the receptacle assembly with one arrangement of circular channels (bores) for emplacement of the electrical contact sockets, and two bores for emplacement of coaxial cable connections, and two section dividers.

FIG. 4 shows a rear interior plan view of the receptacle assembly with the same arrangement of bores as shown in FIG. 3.

FIG. 12 shows a schematic view of the pylon with the plug assembly projecting at the rear top side of the pylon. FIG. 13 shows the pylon skin about the hole through which the plug assembly projects. FIG. 14 shows a port in the side of the pylon, providing wrench access to the drive socket of the cam assembly, and for observation of the visual/tactile indicator button.

FIG. 15 shows a partial section view of the plug housing and the plug insert, including one illustrative electrical pin.

FIG. 16 is a partial section view of the plug housing and the receptacle shell engaged—before the electrical pin/socket mating.

FIG. 17 shows the connector engaged at the receptacle shell and plug housing, and fully mated at the electrical pin/socket contact. The cam is at the fullest vertical extension, just before yieldably turning to the neutral position, shown in FIGS. 15-16, to permit unmating.

SUMMARY OF THE INVENTION

Figure 1:
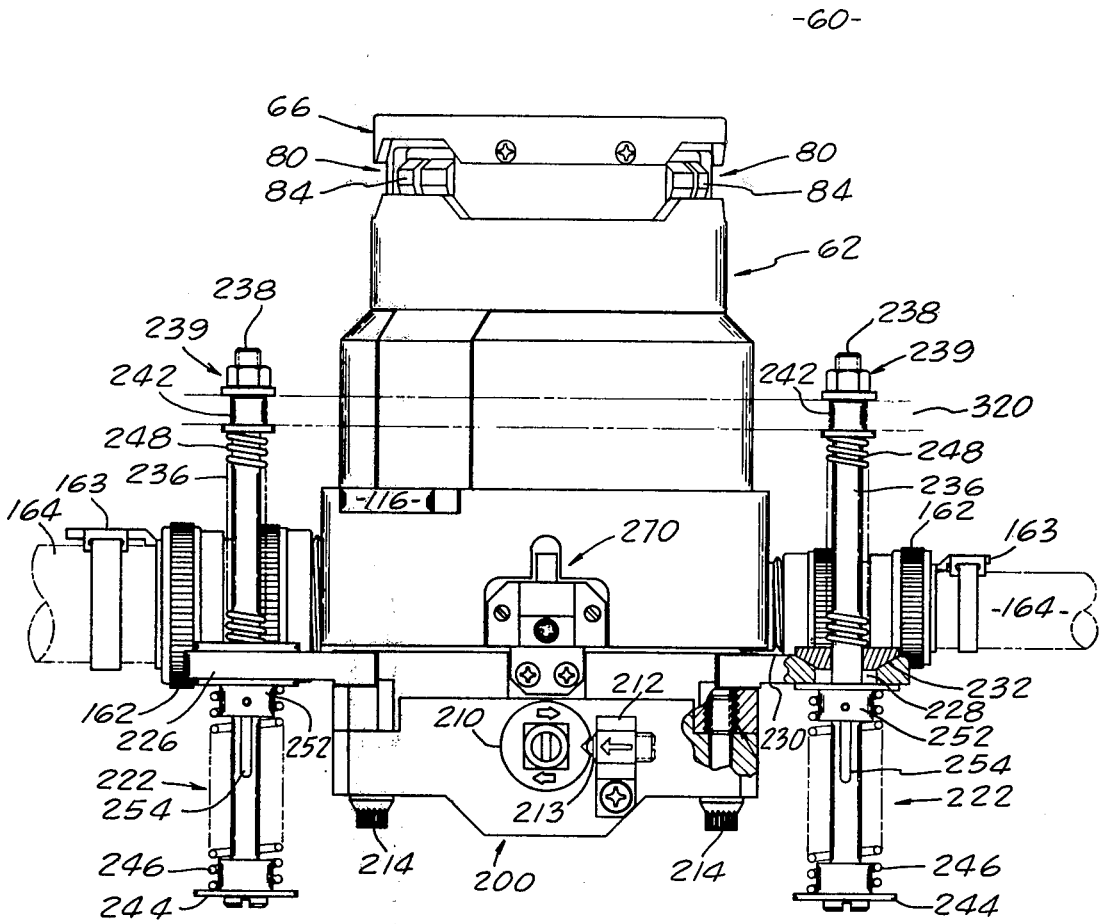
FIG. 1 shows an external plan view of the plug assembly, showing collet fingertips.

The electrical connector of the invention provides for engagement/disengagement of the receptacle/plug assemblies and for mating/unmating of the receptacle/-plug muti-contacts, and comprises:

The receptacle assembly includes a receptacle shell provided with a receptacle barrel having recesses, or a channel, on its outer surface and means for orientation of the relative positions of receptacle and plug assemblies and the electrical socket contacts carried within the barrel.

The plug assembly has a plug housing which includes a collet shell. The collet shell has a collet guide ring located at the end nearest the receptacle assembly, with orientation means at the upper end of the collet shell for relative positioning of the receptacle assembly and the plug assembly. Also, the collet shell has a plurality of collet fingers terminating below the collet shell guide ring; the fingers ending in tips for meshing into the receptacle recesses to engage the receptacle assembly and the plug housing. Further, the collet shell has a plurality of openings located on a common circumference in a lower portion of the collet shell for positioning locking balls, which balls have a diameter substantially larger than the thickness of the collet shell at the locus of the ball openings.

Also, the plug housing includes a locking/release (L/R) sleeve assembly surrounding the collet shell. The L/R sleeve assembly has springs means to move the L/R sleeve in the direction of the collet fingertips, the L/R sleeve overlaps the back of each of the fingertips when the fingertips mesh the receptacle recesses, thereby giving locking engagement to the receptacle assembly and the plug assembly. The L/R sleeve is restrained from the overlapping movement, when the fingertips are outside of the receptacle recesses, below them in space, by the rearends of the fingertips. Also, the L/R sleeve assembly has an annular channel for receiving a substantial amount of the balls and of width such that the initial overlapping movement of the L/R sleeve stops with the balls still in the annular channel. The length of the L/R sleeve provides for a portion beyond the annular channel for covering the ball openings when the L/R sleeve reaches its farthest upward movement. Further, the L/R sleeve assembly has trip ears for contacting tripping surfaces extending into the region wherein the plug assembly is mounted.

Also, the plug assembly includes a stayback assembly positioned inside of the collet shell and including a stayback sleeve extending to the collet fingertips, preventing interior movement of the fingertips. The stayback assembly includes spring means, inside of the collet shell, that urge the stayback sleeve toward the collet fingertips. The end of the stayback sleeve is adapted for stop motion contact, butting with the end of the receptacle barrel nearest the plug assembly.

Also, the plug assembly includes a capsule assembly which comprises a plug contact insert for receiving electrical pin contacts for mating with receptacle electrical sockets, and a capsule shell fitting closely inside the plug housing for carrying the plug contact insert at one end and for providing access to the rear of the plug contact insert; also providing contact surface for a backshell cam assembly to move the capsule assembly into electrically mated relation with the receptacle assembly; and having a plurality of spring cages positioned on the exterior of the capsule shell so as to be compressed when the capsule assembly is moved into electrically mated relation.

The capsule assembly also includes a receiver sleeve positioned closely inside of the collet shell, which receiver sleeve has an inner annular channel having a width which is capable of receiving a substantial width of the collet balls (or the width of the receiver sleeve channel and the thickness of the collet shell at the ball openings is essentially equal to the diameter of the balls). The receiver sleeve channel is so located on the sleeve that when the capsule assembly is moved to electrically mated relation, this channel, the collet shell ball openings, and the end portion of the L/R sleeve for covering the ball openings are juxtaposed. The receiver sleeve includes spring means for compression by the capsule assembly movement upward, which compressed spring means later impart reverse movement to the receiver sleeve during the unmating operation.

The plug assembly includes a backshell cam assembly positioned below the capsule assembly; the cam assembly moves upward (raises) the capsule assembly into mated relation. As a safety measure the cam assembly includes yieldable cam means to limit further upward movement after the fully mated relation has been attained.

The plug assembly includes a mounting means to position and to maintain the plug housing on a support means.

Optionally, the connector includes a visual/tactile indicator of the fully mated relation. This indicator comprises a housing affixed to the plug housing, having a retractable button normally protruding outside the indicator housing. The button terminates inside the housing in a clevis, which clevis is pinned to a ramp slot fixed to the collet shell. When the collet balls, the receiver sleeve annular channel, and the L/R sleeve portion for covering the ball openings are juxtaposed, the upward movement of the L/R sleeve causes the button to ride up the ramp slot and the button retracts inside the housing indicating that the connector is in the fully mated condition.

A preferred mounting means comprises a plurality of mounting post assemblies each comprising a mounting ear extending from the plug housing and having an opening with at least one surface located about that opening having a dish shape (somewhat conical shape) and a cone bushing member position in the dished opening. A rod member passes through the ear opening; spring members are positioned on the rod member on both sides of the ear openings; one of these resting on the cone bushing. These spring members are of substantially equal compressive strength, even though they may not be of substantially equal lengths. Each rod member is attached to a support so that the plurality surrounds the plug housing; each rod member is attached at the top in order to cradle the plug housing.

Preferred orientation means for the receptacle assembly and for the plug assembly comprise a plurality of orientation keys positioned on the exterior surface of the receptacle barrel and a plurality of orientation fan-shaped recesses positioned in an annular inclined inner surface extending from the outer edge of the collet guide ring, for locating corresponding receptacle keys; keyways for receiving the keys are at the base of each fan.

DESCRIPTION OF A PREFERRED EMBODIMENT

Figure 2:
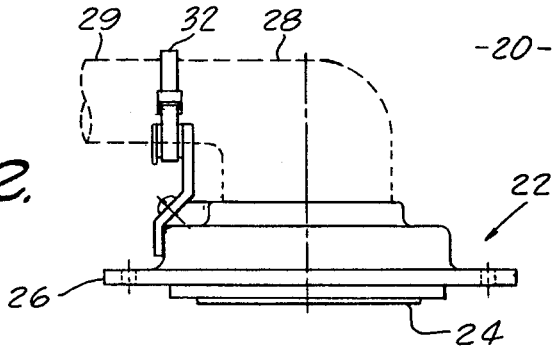
Figure 17:
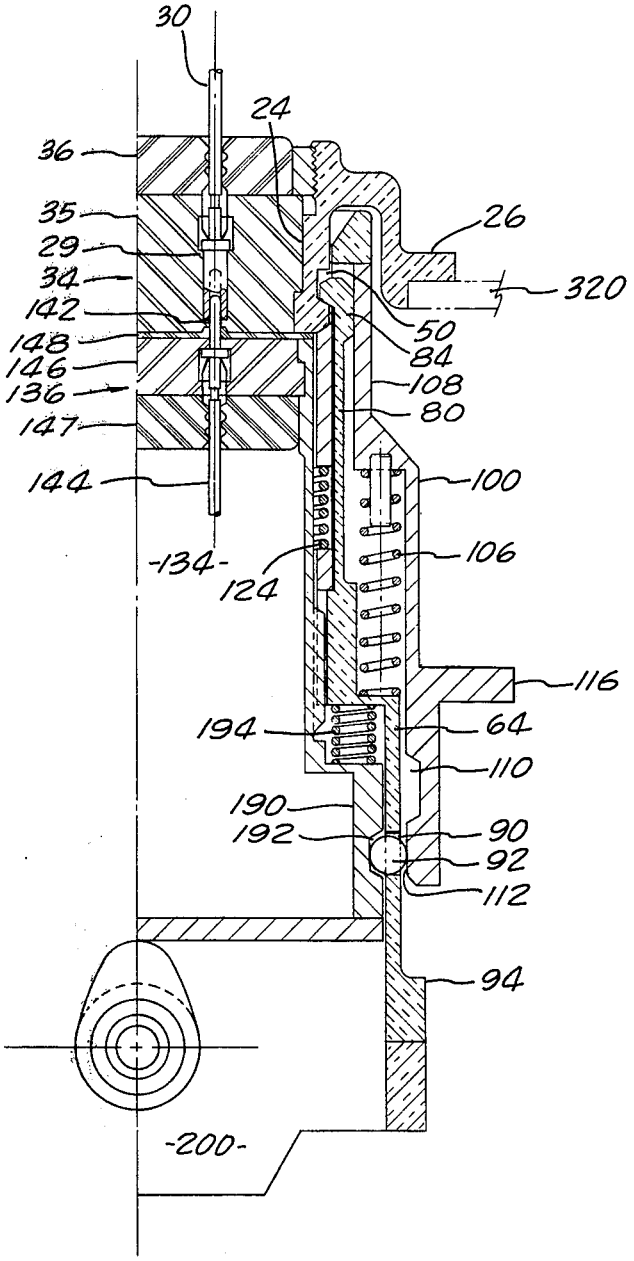

The drawings show a preferred embodiment of the electrical connector of the invention. Briefly, FIG. 1 shows a plan view of the exterior of the plug assembly of the connector; FIG. 2 shows a side exterior view of the receptacle assembly of the connector; and FIG. 17 shows a partial sectional view of the receptacle assembly engaged and electrically mated with the plug assembly.

Figure 4:
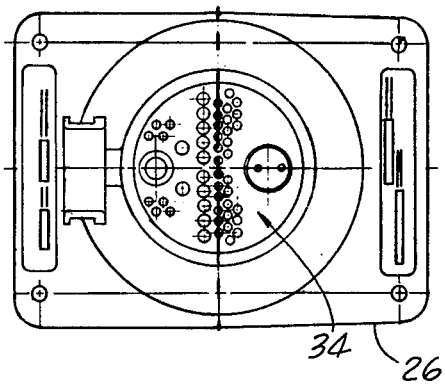
FIGS. 2-4 are views of the receptacle assembly.
Figure 3:
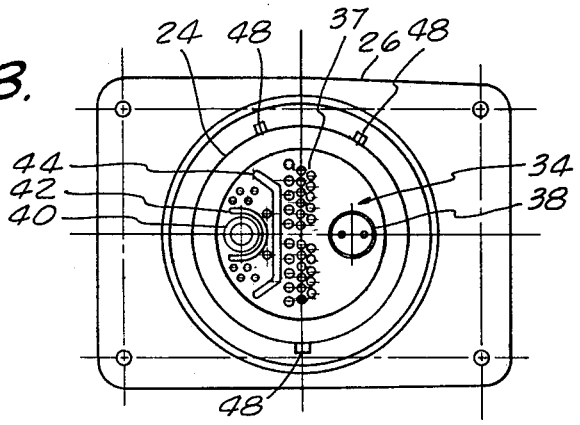
Figure 9:
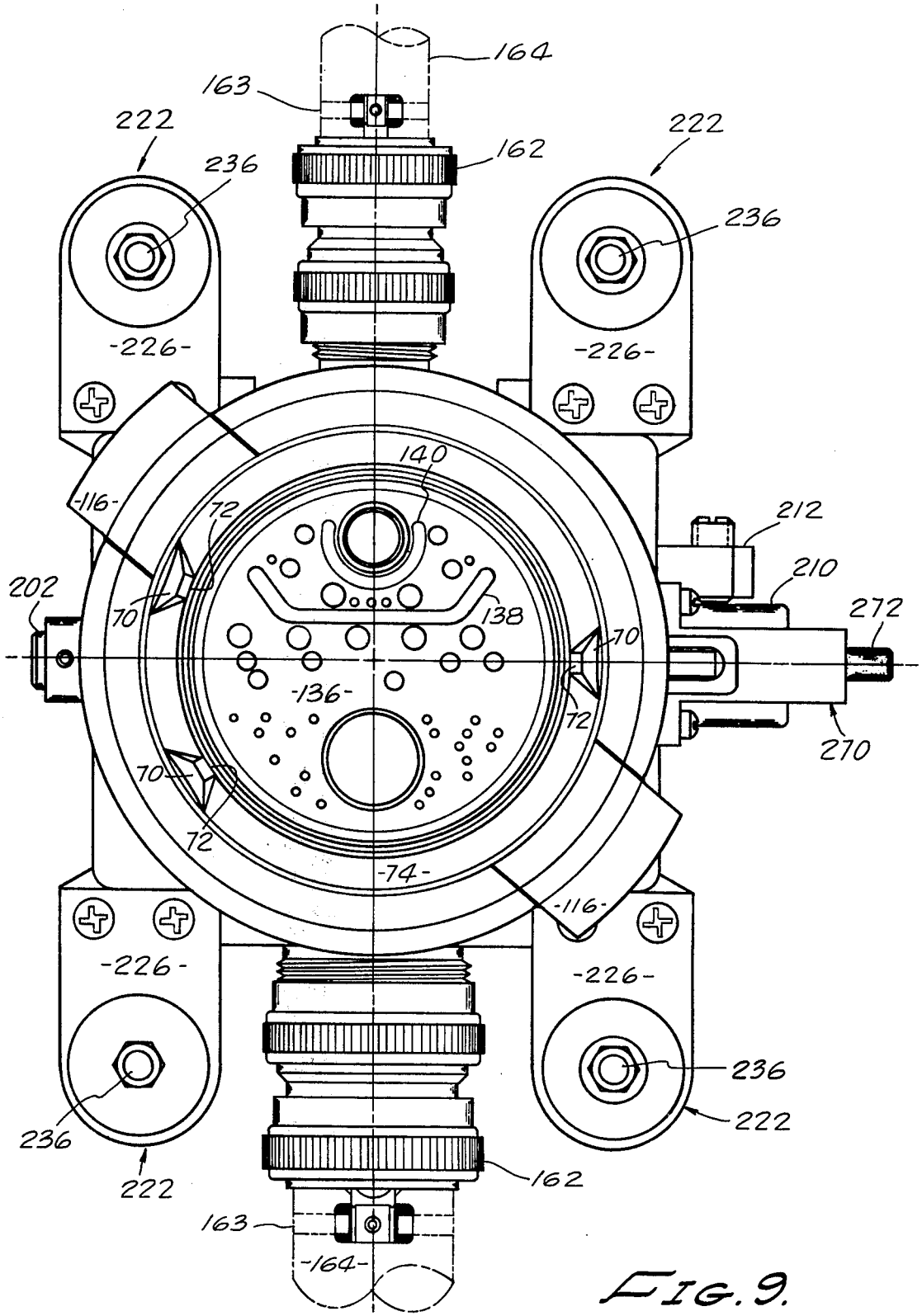
FIG. 9 is a view of the plug assembly from the top side, showing only a 'sampling' of the bores of FIG. 5.
Figure 16:
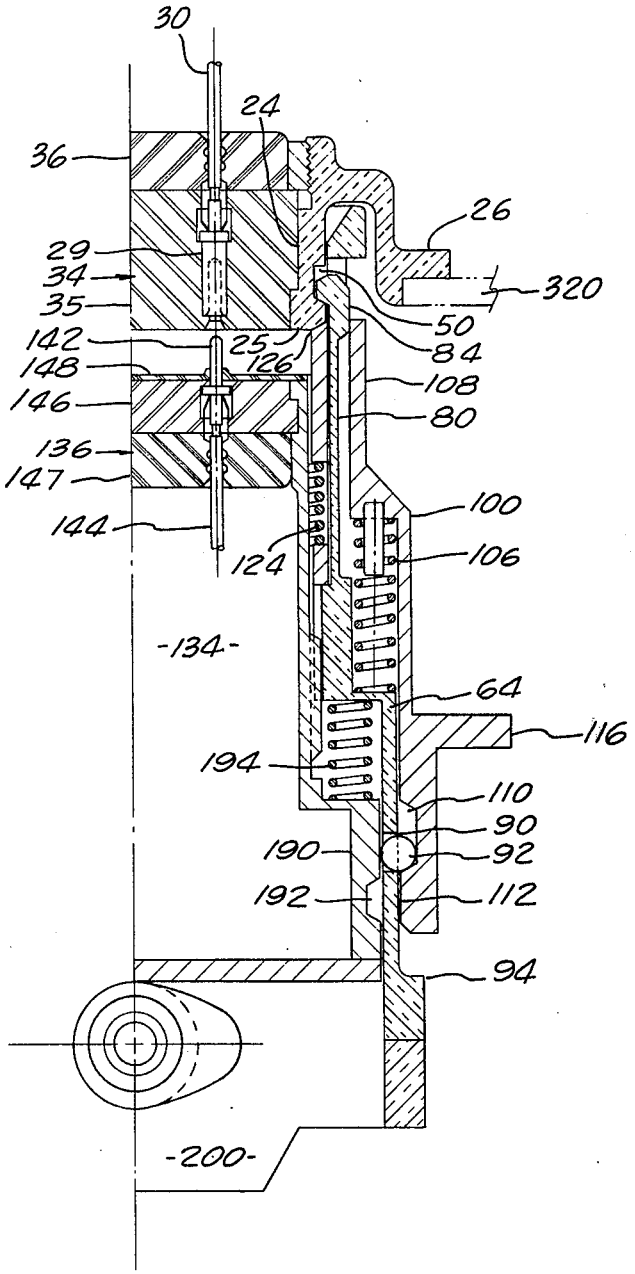

FIG. 2 shows a side exterior view of the receptacle assembly 20 including a receptacle shell 22, which shell 22 is provided with receptacle barrel 24 and mounting flange 26. At the rear of receptacle 20 is shown in dashed lines a back shell 28 and emerging therefrom a cable bundle 29 made up of electrical leads, not shown in FIG. 2, secured by clamp 32, FIG. 3 shows the front of receptacle assembly 20 carrying an insert 34 having an array of electrical socket contacts 37, two coaxial cable connection circular channels (bores) 38 and 40 and two cavities 42 and 44 which section the insert 34 and receive corresponding partitions on the face of plug contact insert 136 (FIG. 9). Orientation means, herein a plurality of orientation keys, for example, three, each numbered 48, are positioned on the exterior surface, at the front end of receptacle barrel 24, for relative positioning of the receptacle/plug assemblies. FIGS. 16–17 show illustrative socket contacts 29; and recesses 50 in the exterior surface of receptacle barrel 24—herein a total of 6 recesses. (Instead of a number of recesses 50, an annular channel can be cut into the exterior surface of the receptacle barrel 24.) FIG. 4 shows the back side of receptacle insert 34; the omitted numbering of the various elements can be developed from FIG. 3.

Figure 5:
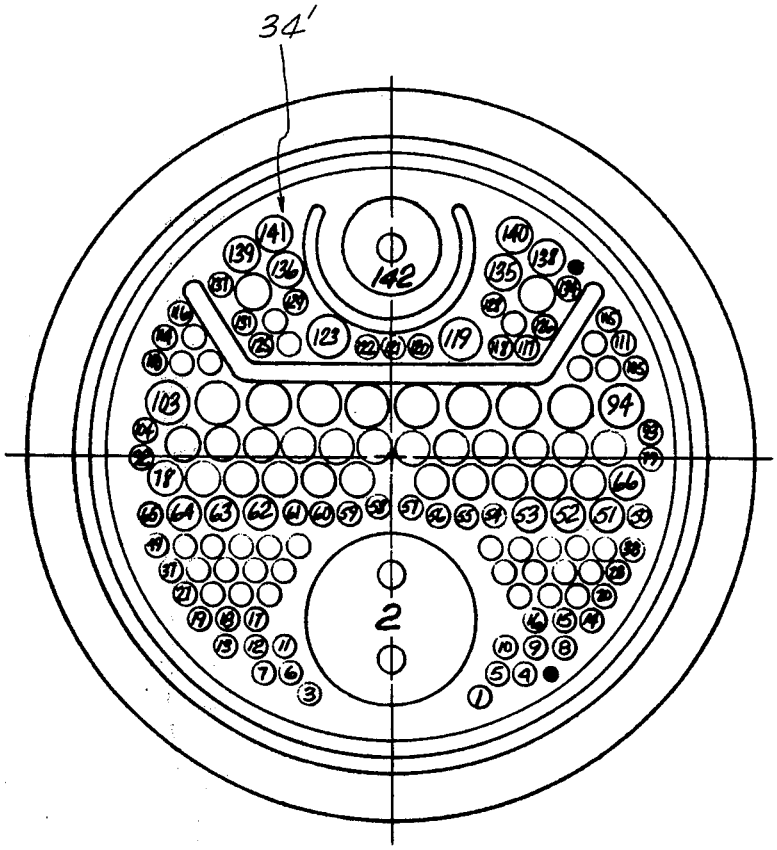
FIG. 5 is a face view of the plug electrical insert and shell of another arrangement of bores, 142 in number, including two for coaxial cable connections, and two section dividers.

FIG. 5 shows a preferred embodiment of a multi-contact receptacle insert 34', having 140 electrical socket contact bores and two coaxial cable connection bores.

Figure 7:
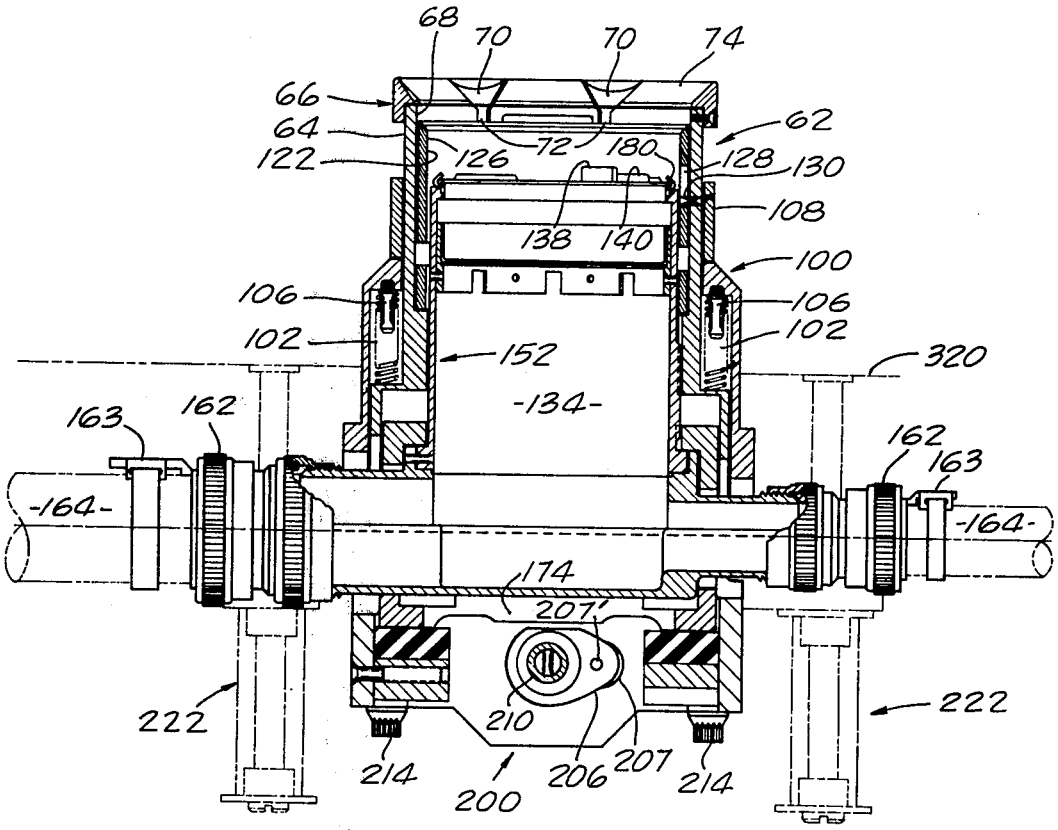
FIG. 7 is an internal sectional view of the plug assembly.
Figure 8:
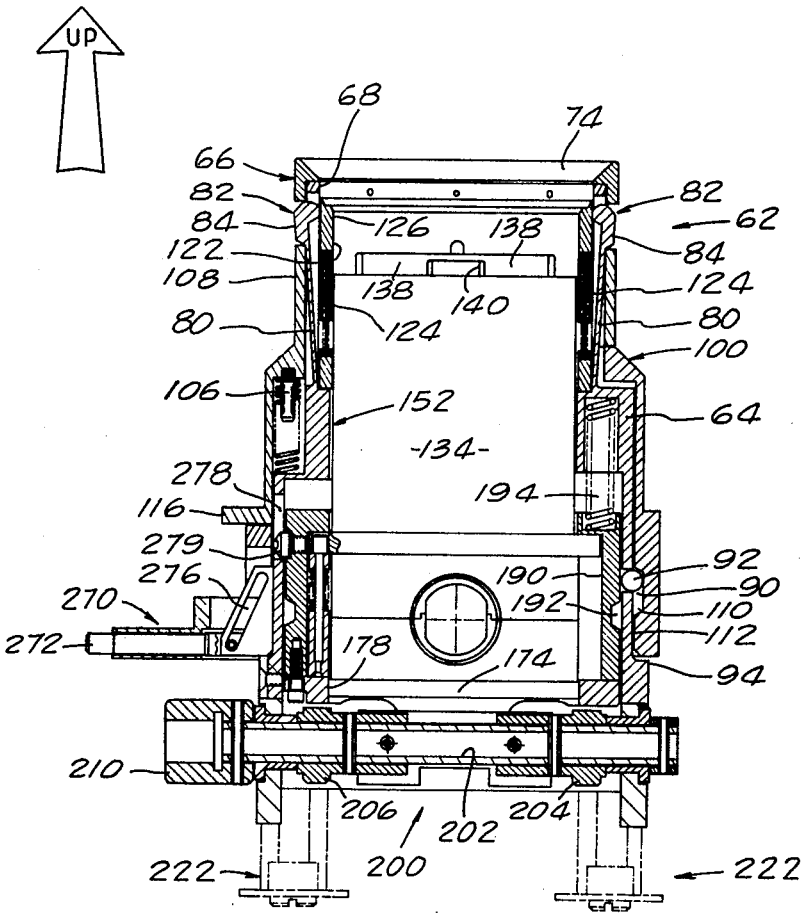
FIG. 8 is an internal sectional view of the plug assembly, turned 90° from the viewpoint of FIG. 7.

In FIGS. 7–8, plug housing 62 includes a collet shell 64 which collet shell 64 has a collet guide ring 66 located at the end 68 nearest the receptacle assembly 20. Collet guide ring 66 has orientation means at the upper end of guide ring 66 for relative positioning of the receptacle/plug assemblies. Herein a plurality of orientation fan-shaped recesses 70 (FIGS. 7 and 9) are positioned in an annular inclined (beveled) inner surface 74 extending from the outer edge of collet guide ring 66. These fans 70 help to locate corresponding receptacle keys 48 (FIG. 3) during the engagement operation. The fans correct for moderate misalignment of the receptacle and plug assemblies. At the base of each fan 70 is a keyway 72 for receiving receptacle key 48.

Figure 6:
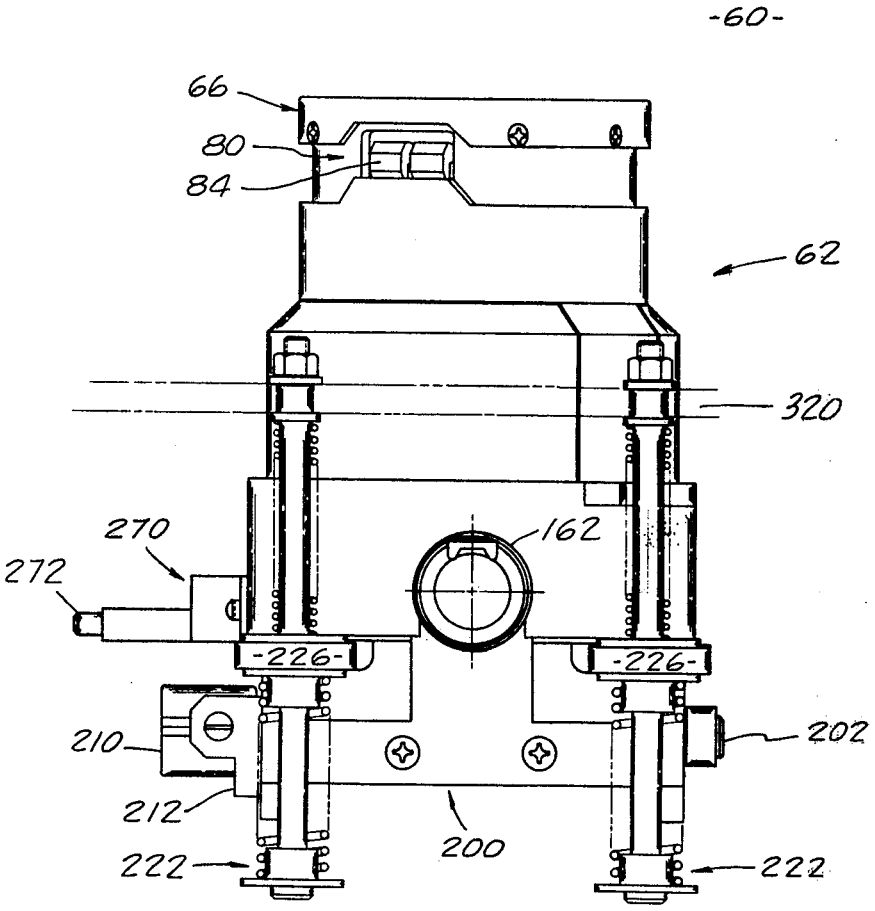
FIG. 6 is an external plan view of the plug assembly of FIG. 1 turned 90° to show the visual/tactile indicator housing and button.
Figure 11:
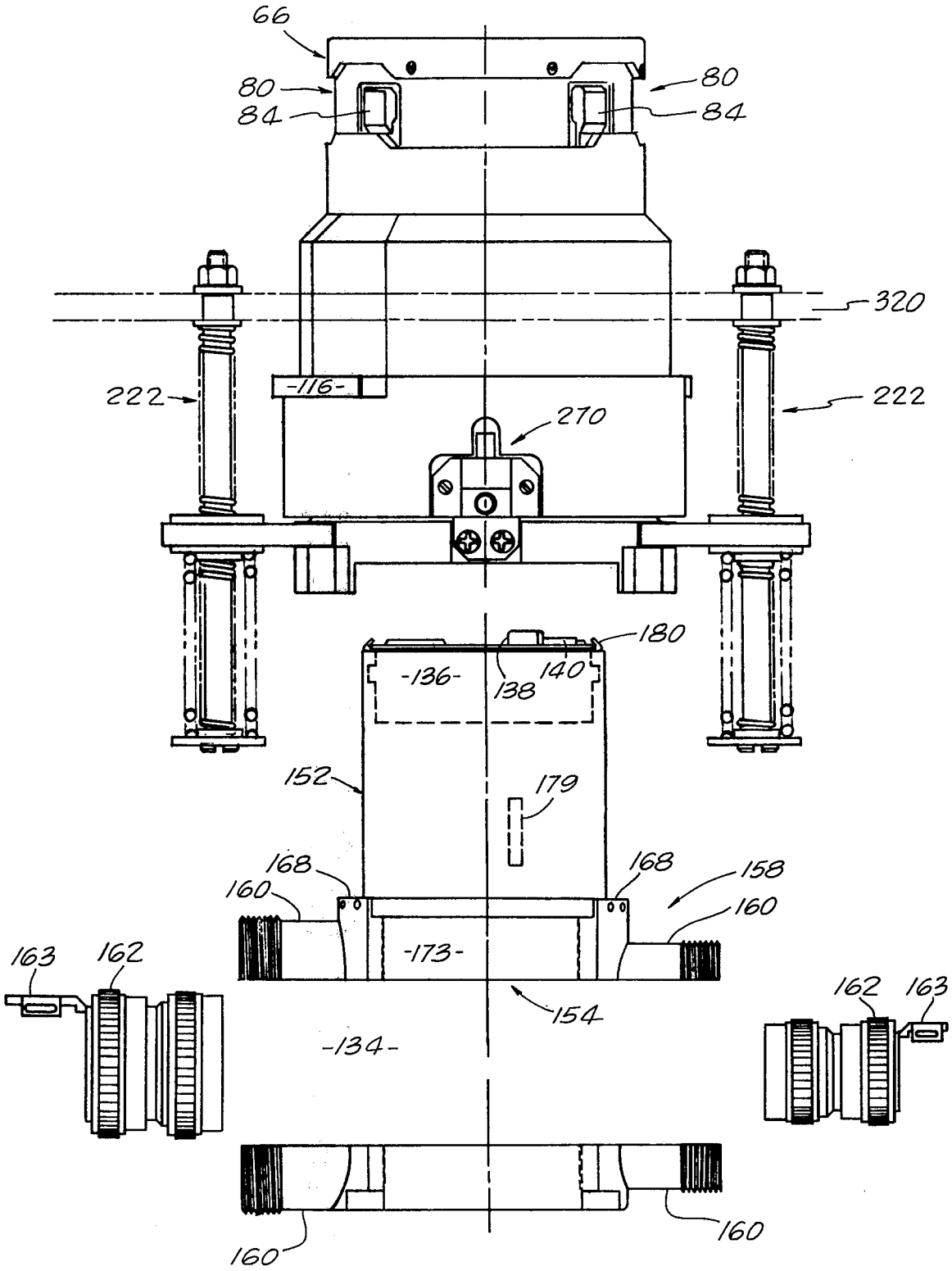
FIGS. 11-11*a* show an exploded view of the plug housing, the capsule assembly, and the backshell cam assembly.

Collet shell 64 has a plurality of collet fingers, each numbered 80, terminating below collet guide ring 66. Each collet finger 80 ends in a fingertip 82 (FIG. 8) which is shaped to mesh (interfit) with receptacle recesses 50 (FIGS. 16–17). Entry of fingertips 82 into receptacle recesses 50 engages the receptacle assembly and the plug housing. The breakaway view of the collet fingers in FIGS. 1, 6 and 11 shows the back 84 of each finger 82. Herein, the embodiment of FIGS. 1, 6 and 8 has 6 collet fingers; the embodiment of FIG. 11 has 3 collet fingers. It is to be understood these numbers of fingers are exemplary only, and not limiting.

Collet shell 64 has a plurality of ball openings 90, shown in FIGS. 8 and 15–18, occupied by balls 92. Herein, 16 ball openings and balls are present. The openings 90 are somewhat larger than the diameter of ball 92 and are located on a common circumference in the lower portion of collet shell 64. Balls 92 have a diameter substantially larger than the thickness of the collet shell 64 at the locus of the ball openings 90.

Figure 18:
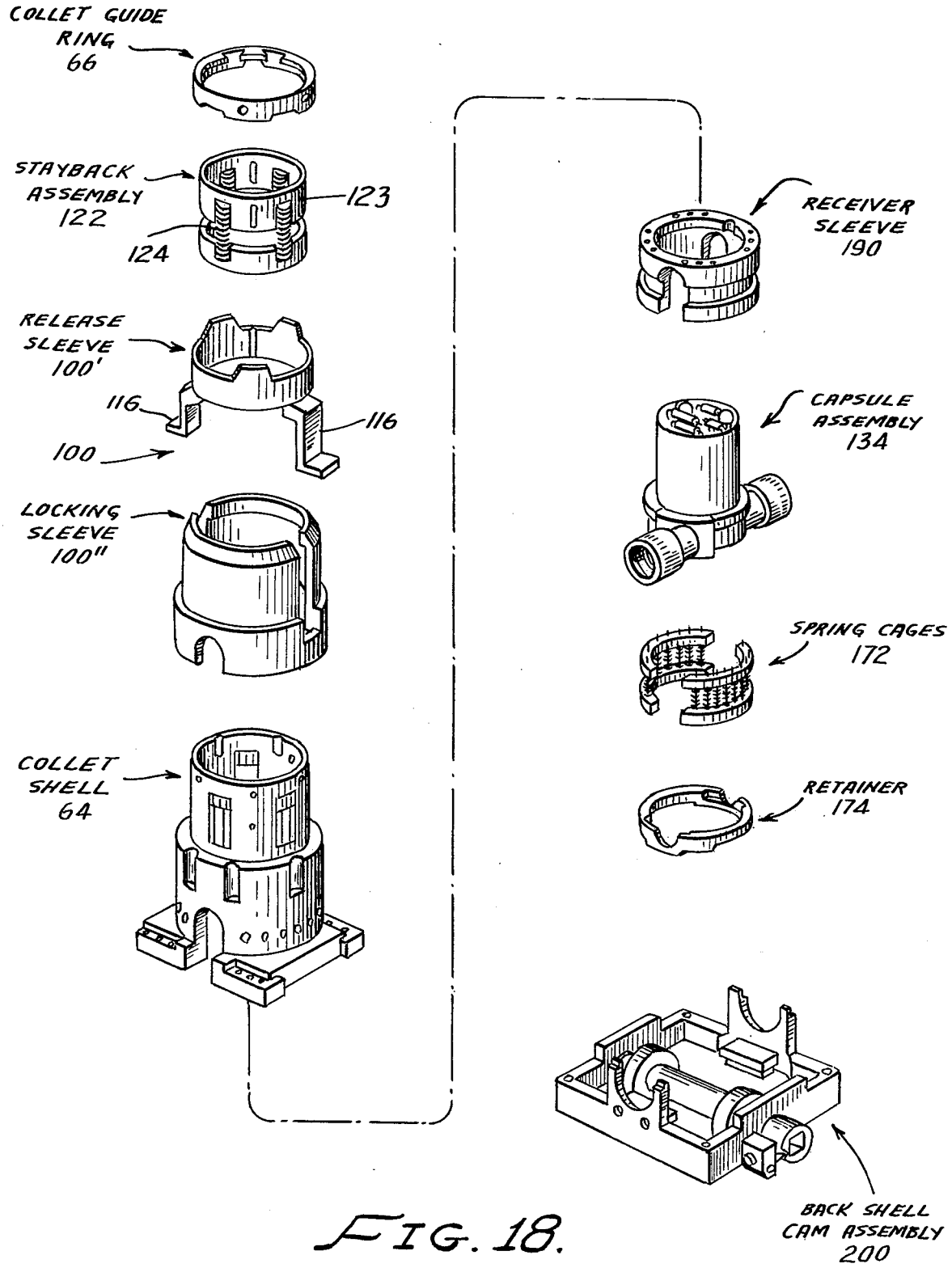
FIG. 18 shows the major components of the plug assembly broken out in isometric views, with terminology provided to facilitate standard usage.

At its lower terminus, collet shell 64 expands to form a seat 94 which seat functions as a further downward movement barrier for hereinafter described locking-/release (L/R) sleeve assembly 100 (FIG. 8). FIG. 18 shows L/R sleeve assembly made up of two major components, namely, release sleeve 100' and locking sleeve 100''.

In FIGS. 7–8, plug housing 62 includes an L/R sleeve assembly 100 surrounding collet shell 64. L/R sleeve assembly 100 has spring means, each numbered 102, to move L/R sleeve assembly 100 in the direction of collet fingertips 82. Spring means 102 is associated with a long lug 106 which acts as a safety in regard to the extent of the compression of spring means 102 and upward travel of L/R sleeve 100. Herein, "upward" has the meaning of movement in the direction of, (or toward), the collet guide ring 66, large arrow in FIG. 8.

Figure 15:
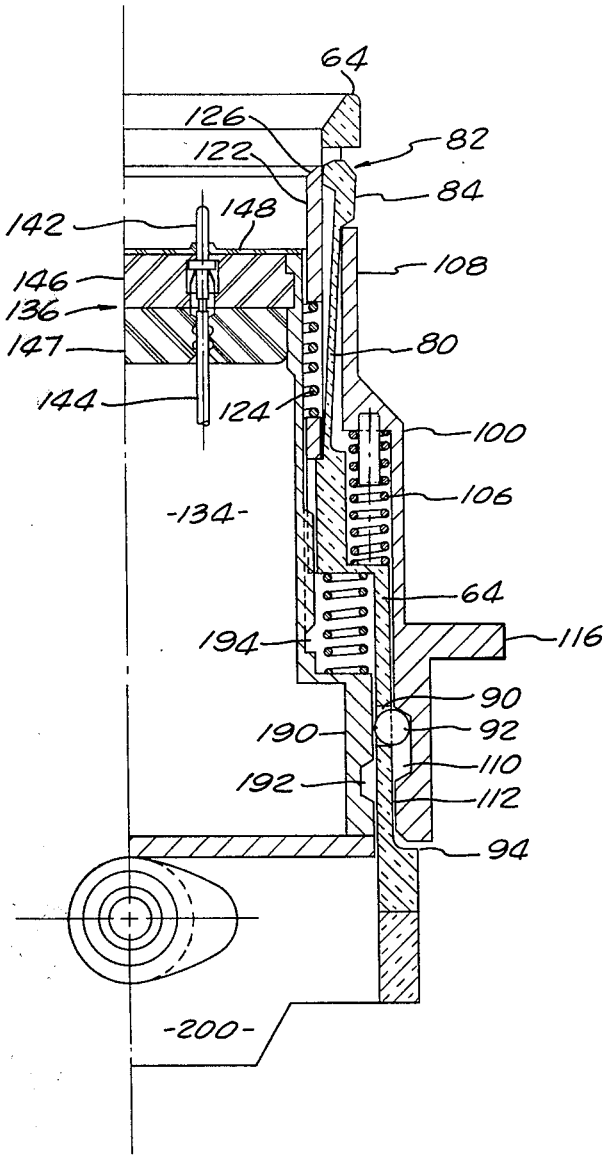
FIGS. 15-17 are directed to the engagement of the receptacle shell and plug housing, and the mating of the pin/socket contacts.

FIGS. 7, 8 and 15 show the plug assembly in the cocked position, ready for engagement of the receptacle assembly. The upper end 108 of L/R sleeve 100 is restrained from upward movement by the rear ends of collet fingertips 82.

When the fingertips 82 mesh with the recesses 50 of the receptacle barrel 24 (FIG. 16) the movement of the fingertips 82 toward the interior region of the connector at the recesses 50 permits the upper portion 108 of L/R sleeve 100 to move upward overlapping the backs 84 of each fingertip 82, thereby giving locking engagement of the receptacle and plug assemblies.

L/R sleeve 100 has an annular channel 110 which channel is able to receive a substantial amount of the diameter of each of the balls 92 (FIG. 8). The width of channel 110, the upward dimension, is substantially equal to aforesaid overlapping movement of L/R sleeve 100. Balls 92 stop the initial upward movement of L/R sleeve 100 (FIG. 16). The extent of the second upward movement of L/R sleeve 100 is illustrated in FIG. 17.

L/R sleeve 100 extends beyond the annular channel 110 for a portion 112 of a length capable of covering (riding over) the ball openings 90 and balls 92 when the L/R sleeve 100 reaches its farthest (maximum) upward movement (FIG. 17).

L/R sleeve 100 has trip ears 116 which extend outwardly far enough to contact tripping means, such as the pylon skin 320 (FIGS. 12–13) extending into the region wherein said plug assembly is mounted (FIGS. 1, 12–13, and 15–18). Ears 116 may be tripped by motor driven means, or solenoid driven means, and the like, independently of the mounting surface.

Plug housing 62 includes a stayback assembly 122 (FIGS. 7–8, and 18) positioned closely inside collet shell 64 and extending upwardly to about the forward end of collet fingertips 82. Collet fingertips 82 tend to move toward the interior of the plug housing; stayback sleeve 123 prevents such interior movement of fingertips 82.

Stayback assembly 122 includes spring means 124 which spring means 124 urge the stayback sleeve 123 toward said fingertips 82. The upper end 126 of stayback sleeve 123 is adapted for contacting (butting) the lower end 25 of receptacle barrel 24. Barrel 24 stops the upward motion of stayback assembly 122 as the receptacle assembly is secured to a rigid surface, such as, an aircraft wing.

Spring means 124 cushion the impact of stayback assembly 122 with receptacle barrel 24 and then allows the sleeve 123 to recoil, while the collet shell 64 continues moving upwardly. The stayback assembly 122 is maintained in normal maximum up-position, relative to collet shell 64, by a slot 128 (FIG. 7) in the sleeve 123, which slot 128 is governed by a keeper pin 130 anchored in collet shell 64 and extending into slot 128. Slot 128 is desirably of a length such that further downward movement of stayback sleeve 123 is barred, when the collet fingertips 82 have been released for interior movement into recesses 50 and the upper end of stayback sleeve 123 is in contact with receptacle barrel end 25.

Plug assembly 60 includes a capsule assembly 134 positioned inside of plug housing 62 (FIGS. 8–9, 11 and 18). Capsule assembly 134 is separate from plug housing 62 and back shell cam assembly 200, but not independent therefrom.

FIG. 9 shows a top view of plug contact insert 136 having two partitions 138 and 140 which section the top face of insert 136. The height of the partitions is sufficient to prevent pin contacts in one section from bending over onto pin contacts in another section.

In FIGS. 15–17, plug contact insert 136 is provided with bores for receiving electrical pin contacts, illustrated by 142, and electrical lead 144, for mating with receptacle electrical sockets, illustrated by 29 and electrical lead 30.

In FIGS. 15–17, inserts 34 and 136 include rigid insulators, illustrated as one piece construction: number 146 for plug insert 136; and number 35 for receptacle insert 34. A grommet seal 147 is tightly adhered to the rear of insulator 146; and a grommet seal 36 is tightly adhered to the rear of insulator 35. The top face of the plug insulator 146 has bonded thereto a resilient interfacial seal 148. This interfacial seal provides a seal around each individual contact, in the mated relation, to ensure circuit isolation between each pin/socket contact, and also between the contacts and the plug contack shell 152.

The preferred material for the grommet seals and for the interfacial seal is fluorosilicone elastomer. A preferred insulator material is epoxy Epiall (trademark) which is glass fiber filled.

Capsule assembly 134 includes a plug contact shell 152, made of conductive material, shown in FIGS. 7, 8, 11 and 15–18. Plug shell 152 fits closely inside plug housing 62 and carries plug contact insert 136 at the upper end. Access to the rear of plug contact insert 136 is provided through bottom opening 154 (FIG. 11). FIG. 11 shows the capsule assembly 134 dropping from the bottom of the plug housing.

Plug contact shell 152, through backshell cover 158, provides a seat 168, extending along the vertical wall of shell 152. A plurality of spring cages 172 (FIGS. 11*a* and 18) are positioned on the exterior 173 of the backshell cover 156 by way of retainer 174 and associated fasteners 176. Spring cages 172 are compressed when the capsule assembly 134 is moved into fully mated relation. Retainer 174 not only captivates the spring cages 172 but also the plug contact shell itself, through backshell cam assembly 200.

Plug contact shell 152 through the back side of annular retainer member 178 (FIG. 8) provides contact surfaces by which cam assembly 200 moves the capsule assembly 134 upward into fully mated relation with the receptacle assembly.

Desirably, capsule assembly 134 is aided in control of vertical movement by key 179, on the far side in FIG. 11, protruding from plug shell 152 and moving in a vertical keyway, not shown, in the interior of the plug housing.

Preferably, EMI spring contact fingers 180 (FIGS. 7 and 11) are affixed to the periphery of plug insulator 146 at the upper face thereof. The flexible conducting spring fingers do not interfere with engagement of the receptacle assembly or with the mating with the receptacle contacts. On mating, spring fingers 180 make electrical contact with the end 25 of receptacle barrel 24, permitting current to flow through the connector.

Capsule assembly 134 includes a receiver sleeve 190 positioned about the lower portion of plug shell 152 inside collet shell 64 (FIG. 8). Receiver sleeve 190 (FIG. 18) has an annular channel 192 of a depth to receive a substantial width of collet balls 92. Desirably, the depth of channel 192 and the thickness of collet shell ball openings 90 is essentially equal to the diameter of ball 92. Annular channel 192 is located on receiver sleeve 190 so that, when capsule assembly 134 moves to fully mated relation, the ball openings 90, the lower portion 112 of L/R sleeve 100, and the channel 192 are juxtaposed (FIG. 17). Spring means 194, associated with receiver sleeve 190, are compressed by upward movement of the capsule assembly 134; later compressed spring means 194 imparts reverse (downward) movement to receiver sleeve 190.

Figure 10:
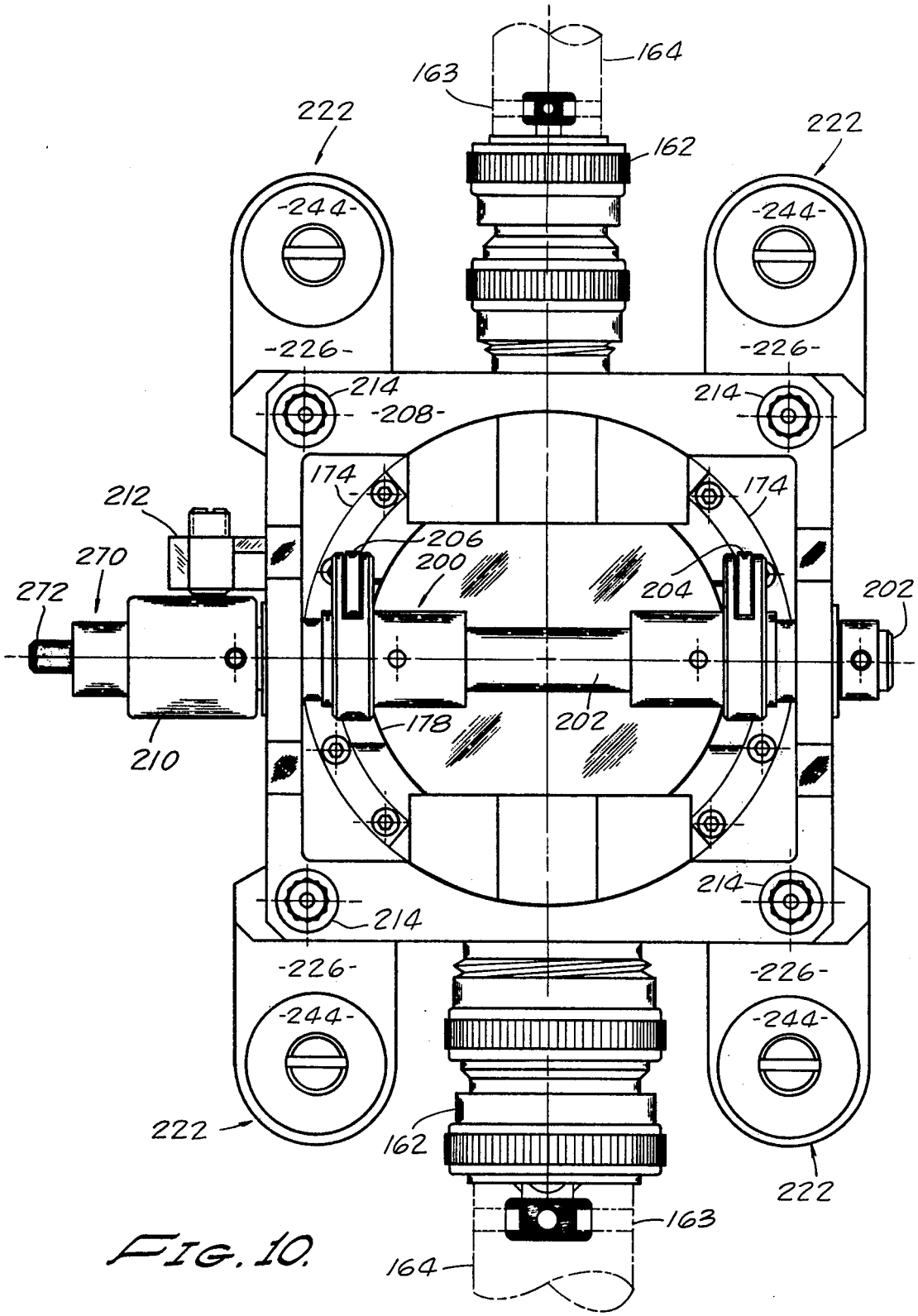
FIG. 10 is a view of the plug assembly from the bottom side, showing the visual/tactile indicator and backshell cam assembly.

Capsule assembly 134 is moved to fully mated relation by backshell cam assembly 200 positioned below capsule assembly 134 (FIGS. 1 and 6–11*a*) FIG. 10 shows a view of the cam assembly 200 looking up at the bottom. At the center of the view is drive shaft 202 having mounted thereon cams 204 and 206. On the left outside of the frame 208, on which drive shaft 202 is mounted, is a drive socket and a snubber 212. Herein, frame 208 is mounted to the plug housing by screw fasteners 214.

FIG. 1 shows a front plan view of cam assembly 200 with two of four mounting screw fasteners 214 showing. The front of drive socket 210 and snubber 212 is shown. Herein, cams 204 and 206 have an ogive shaped end and a semi-circular shaped other end. A wheel 207 is mounted at the ogive end to give the ogive end a true circular radius. Wheel 207 is mounted to rotate freely about its own center 207' (FIG. 7). Capsule assembly 134 is moved upward by inserting a speed wrench into drive socket 210 and turning the wrench until full pin/socket contact mating is accomplished and the interfacial seal 148 is correctly loaded. An auxialiary motor driven device may be employed to perform this function automatically, thereby negating the need for hand wrenching. Spring cages 172 provide an overriding action when interfacial seal 148 is fully compressed against the receptacle insert face. When fully mated relation has been achieved, capsule assembly 134 is latched (locked) in position by the juxtaposition of annular channels, balls 92, and end 112 of collet shell 64 (FIG. 17). At this instant, the cam assembly 200 drive yields when further wrench rotation is attempted, that is, any attempt to get further upward movement is prevented by the yielding action imparted by the wheel 207 as the wheel 207 contacts the bearing surfaces at the maximum height of the capsule assembly 134. Wheel 207 simply carries the cam around past the maximum elevation so rapidly, if the wrench action is continued, that the cam goes to the neutral (horizontal) position.

Also this yielding action prevents the wrench, in attempted reverse rotation, from unmating the pin/socket contacts; there is no possibility of damaging the connector by over-travel (overdrive) of the cam assembly.

Cams 204 and 206 at rest, in the neutral position, are as shown in FIGS. 7 and 15–16 where wheel 207 is omitted in FIGS. 15–17. The wrench action brings the cam to the vertical position of FIG. 17. The rotation of wheel 207 makes it almost impossible to leave the cams in the vertical position; momentum carries the yielding cams to the horizontal neutral position. The cam assembly is held in this neutral position by snubber 212 whose spring loaded conical nose pin 213 engages a groove in the outside face of drive shaft 210, thereby maintaining the cams in the neutral position.

Figure 11A:
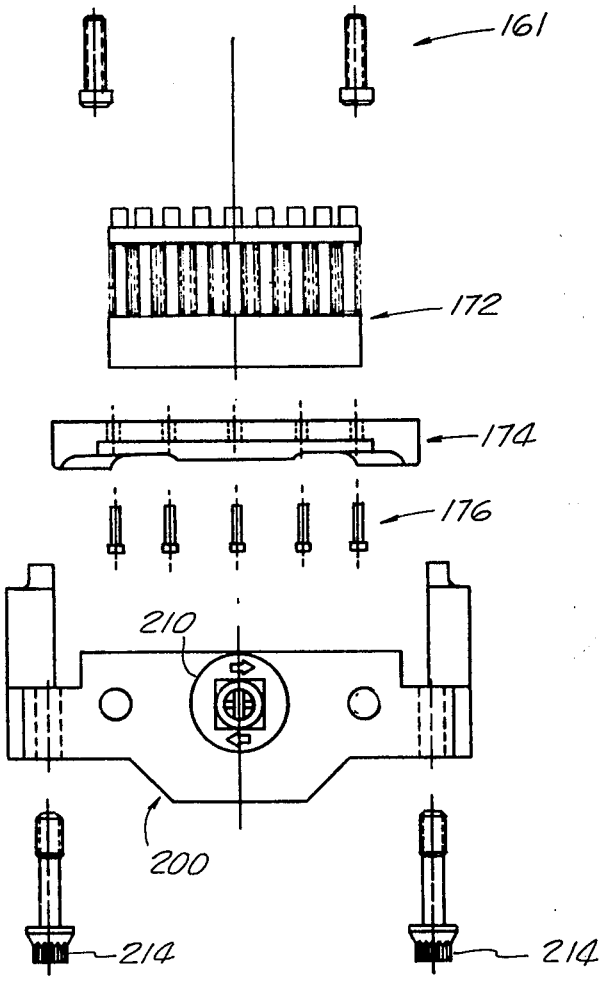

Capsule assembly 134 is readily removable from the plug housing. The cam assembly 200 is removed by withdrawing fasteners 214 (FIG. 11*a*). Retainer 174 is released by withdrawing fasteners 176. Cam assembly 200 is then slipped out taking care that spring cages 172 do not drop when capsule assembly 134 emerges from the plug housing. FIG. 8 shows a long slot 278 into which limit screw 279 fits and captivates receiver sleeve 190, so that it (190) cannot fall out when capsule assembly 134 is removed.

Plug assembly 60 is associated with a mounting means to position and to maintain the plug housing on a support. Herein, the mounting means comprises a plurality of mounting post assemblies 222. Each of the mounting post assemblies 222 (FIG. 1) comprises a mounting ear 226 extending outwardly from plug housing 62. Ear 226 has an opening 228. At least one surface about ear opening 228 has a dished, roughly conical shape; herein, the upper surface 230 of ear 226 about opening 228 is dished. A cone bushing member 232 is positioned in the dished surface about opening 228. When both surfaces are dished each will include a cone bushing member.

Figure 12:
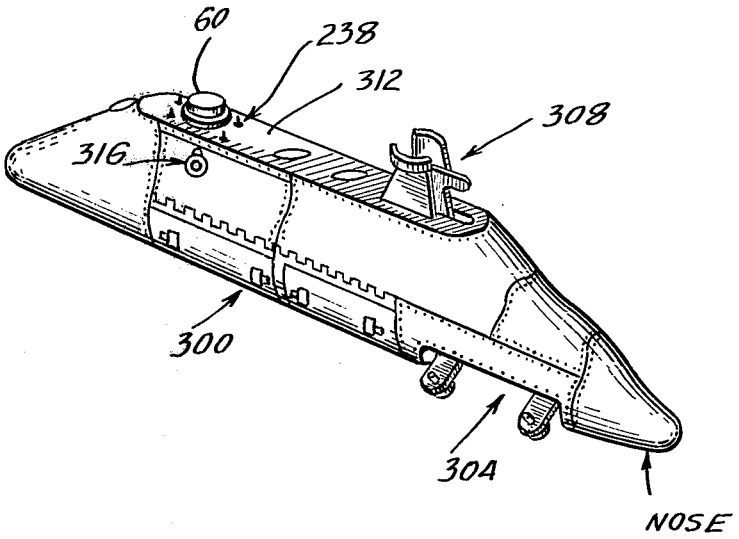
FIGS. 12-14 are directed to a wing mounted pylon.
Figure 13:
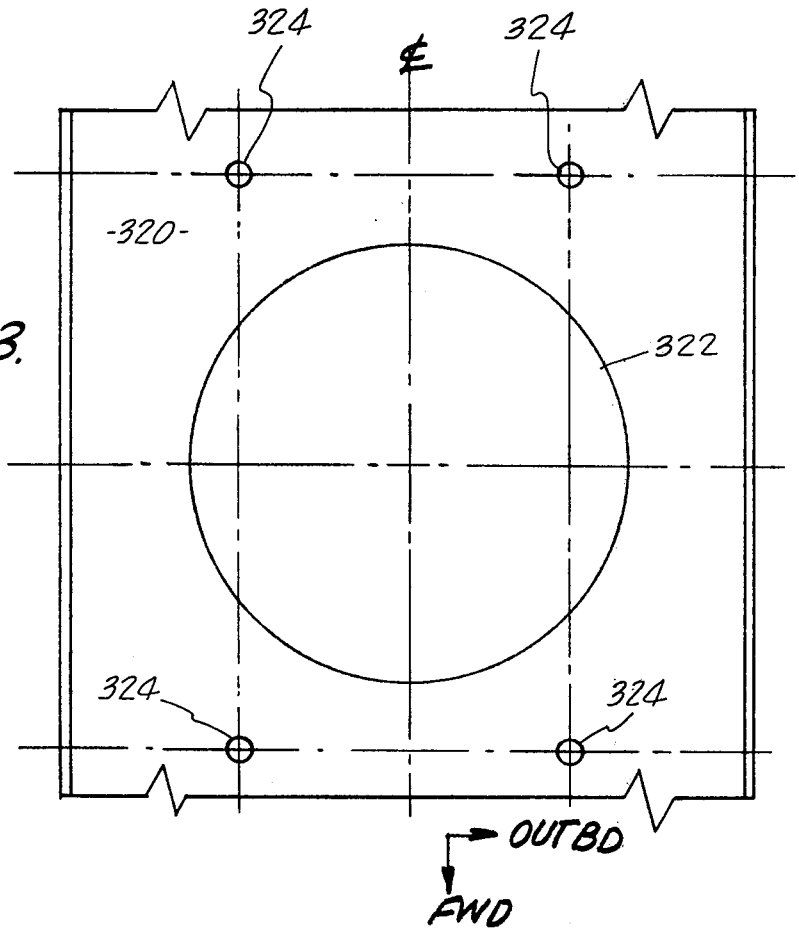

A rod member 236, herein a bolt, passes through ear opening 228 and through cone bushing 232. The upper end 238 passes through an opening in the support structure for the plug assembly, such as an aircraft pylon skin 320 (FIGS. 12–13). The rod 236 is secured herein by a self-locking nut over a washer 239. A tee nut 242 acts as a bearing and washer. At the lower end of rod 236, another tee washer 244 supports a spring member 246. Another spring member 248 is mounted on rod 236 above cone bushing 232. Spring members 246 and 248 are substantially equal in compressive strength, even though as here the two are not of equal length. Below the cone bushing, a bushing 252 retains spring 246. A slot 254 is cut through rod 236 below the lower surface of ear 226 and a pin, not numbered, passes through bushing 252 and slot 254 and positions the plug assembly to extend a predetermined distance above mounting panel 320 to facilitate subsequent engagement with the receptacle assembly.

The mounting assemblies 222 serve to float the plug assembly, aid in taking up receptacle/plug misalignment, provide for the maximum protrusion of the plug beyond the pylon surface (FIG. 12), and adjust for the vertical difference between inboard and outboard wing positions caused by wing taper.

Optionally, but preferably, the connector of the invention includes a visual/tactile full mate indicator comprising a housing 270, herein, affixed to L/R sleeve 100 (FIG. 8) positioned above drive socket 210. A retractable button 272 normally protrudes outside housing 270 to indicate a "no mate relation" of the receptacle/plug assemblies. Button 272 terminates in a clevis which is pinned to a ramp slot 276. Ramp slot 276 is fixed to the outside of collet shell 64, and ramp slot 276 is itself stationary. When release sleeve 100′ moves up, button 272 rides up the ramp slot 276 and retracts completely, when the receptacle/plug assemblies are fully mated and latched in that relation by juxtaposed collet balls 92, L/R sleeve end portion 112, and receiver sleeve channel 192. Unmating the receptacle/plug assemblies causes the three-way juxtaposed relation to break apart, the L/R sleeve moves down, the button moves down the ramp and again protrudes outside the housing indicating the "no mate relation".

FIG. 12 roughly illustrates the exterior of an aircraft pylon 300 with missle attachment fixture 304. A hook assembly 308 attaches the front (nose) of the pylon to the botton of an aircraft wing, not shown. At the rear of the pylon plug assembly 60 protrudes above the support surface 312 where end 238 of the mounting post assemblies are shown. Port 316 on the side of the pylon below the plug assembly provides access to crank shaft 210 for mating the receptacle/plug socket contacts and also provides an opening for observation of the visual/tactile indicator button 272.

Figure 14:
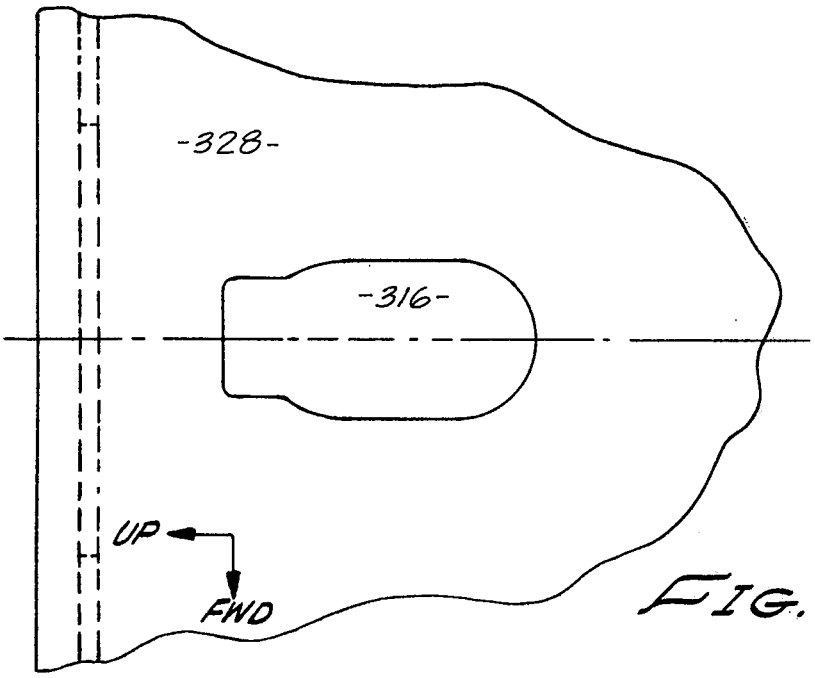

FIG. 13 shows the pylon skin 320 about opening 322 through which plug assembly 60 protrudes (FIG. 12). The four small openings 324 provide exit channels and support for mounting post assembly rod members 236 and locking nut and washer 239 (FIG. 1). FIG. 14 shows the pylon skin 328 about port 326.

In FIGS. 13–14, "OUTBD, FWD" indicates outboard direction and forward direction, and along with "UPFWD" orient the skin portions with respect to pylon 300 and the aircraft wing.

FIGS. 15–17 illustrate the plug assembly in the cocked position ready for engagement; the receptacle/plug assemblies engaged but not mated; and the receptacle/plug assemblies engaged, locked and fully mated.

FIG. 16 shows upward movement of the plug assembly, such as moving the rear of the pylon into wing-locked position would impart, causes end 126 of stayback sleeve 123 to butt against end 25 of receptacle barrel 24; further upward movement forces stayback sleeve 123, releasing collet fingertips 82; still more upward movement brings fingertips into register with receptacle barrel channel 50 and fingertips 82 mesh therewith, engaging the receptacle/plug assemblies. Simultaneously L/R sleeve 100 moves upward until the rear end of channel 110 butts into ball 92, then L/R sleeve 100 locks the engaged receptacle/plug assemblies by overlapping upper portion 108 over the backs 84 of fingertips 82. The forces transmitted to the wing are those resulting from the engaging/locking action of the receptacle/plug assemblies. An embodiment of the invention built as described met the 50 foot pounds specification.

In FIG. 17, the capsule assembly is forced upward by a wrench powered movement of the cam assembly 200. Illustrative pin contact 142 enters socket 29 establishing the fully mated relation; interfacial seal 148 is brought into sealing relation with the pins and the face of receptacle insert 34. Spring 194 and spring cages 172 are compressed; later these springs impart reverse (unmating) movement to the capsule assembly 134. Also upward movement of the receiver sleeve 190 through the cam action brings channel 192 into juxtaposition with collet balls 92. Balls 92 move into channel 192 and openings 90, causing L/R sleeve 100 to be released and moved upward by spring 106 to the farthest up position of L/R sleeve 100 against the lower end of collet guide ring 66; end portion 112 rests over (against) balls 92, effectively latching (locking) the capsule assembly from further movement in either vertical direction. The connector is now engaged/locked and fully mated. At this point, the visual/tactile indicator button has moved inside its housing to signal the fully mated relation.

The yielding characteristic, also describable as a "go limp action", of the cam assembly prevents damaging force being applied to the pin/socket contacts after full mate relation has been achieved. Also the yielding characteristic carries the cam to the neutral position and prevents the cam from interfering with subsequent unmating and disengagement.

Because the mating force is applied after the receptacle and plug housing are engaged, all the force stays inside the connector and none is transferred to the aircraft wing.

The unmating/disengagement of the connector is described in connection with FIGS. 1, 8 and 12–17. The downward movement of the pylon, as it is released from the wing, causes the support skin 320 to press on the release ears 116; ears 116 force the L/R sleeve 100 to retract far enough to have balls 92 slip from locking groove 192, thereby allowing springs 172 and 194 to force the plug insert assembly 134 to unmate from the receptacle insert. At this moment, fingertips 82 are still locked to the receptacle barrel preventing the pin/-socket unmating forces from being transferred to the aircraft wing. Visual/tactile indicator button now protrudes outside its housing, indicating a no mate relation. Continued pylon drop causes the L/R sleeve to retract all the way, allowing collet fingertips to release their grip on the receptacle barrel channel. Complete pylon drop frees the plug assembly from the receptacle assembly.

Stayback assembly 122 advances to its fully extended position, under the influence of spring 124, and again holds collet fingertips in ready-to-engage position. Now L/R sleeve 100 is in cocked position ready to lock collet fingertips when the plug is again engaged with receptacle. The compression springs in the mounting post assemblies 222 balance each other causing the plug housing to assume its normal free unmated maximum protrusion position, and the centered cone bushings 232 cam the plug housing to the centered position. Thus the connector automatically unmates the plug/receptacle assemblies, and recocks the plug assembly ready for another engagement, mating and latching.

The aforesaid description has centered on a manually actuated engagement, mating and locking, followed by either manually actuated, or gravity jettison actuation, unmating, and disengagement. It is to be understood that the construction of the connector of the invention makes it amenable to full automatic control. It can be used in a location where the engagement/mating and locking and subsequent unlocking, unmating and disengagement is automatic, for example, by signals sent to a motor drive coupled with the plug assembly. Other mechanical expedients can be readily devised.

Thus having described the invention, what is claimed is:

1. A multi-contact electrical connector adapted for sequential engagement/mating/ locking of the receptacle/plug assemblies and for sequential unmating/unlocking/disengagement of the receptacle/plug assemblies, which connector comprises:

(1) a receptacle assembly including
- (a) a receptacle shell provided with a receptacle barrel;
- (b) electrical socket contacts carried within said receptacle barrel;
- (c) recesses in the exterior surface of said receptacle barrel; and
- (d) orientation means on said receptacle barrel for relative positioning of said receptacle assembly and said plug assembly;

(2) a plug assembly having a plug housing including
- (a) a collet shell having
  - (i) a collet guide ring located at the end nearest said receptacle assembly, having orientation means at the upper end of said guide ring for relative positioning, in cooperation with said receptacle orientation means, of said receptacle and said plug assemblies;
  - (ii) a plurality of collet fingers terminating below said guide ring, said fingers ending in tips for meshing into said receptacle recesses to engage said receptacle assembly and said plug housing; and
  - (iii) a plurality of openings in said collet shell located on a common circumference of said collet shell, for positioning balls, which balls have a diameter substantially larger than the thickness of said collet shell at the locus of said ball openings;
- (b) a locking/release sleeve assembly surrounding said collet shell,
  - (i) having spring means to move said locking-/release sleeve assembly in the direcion of said collet fingertips, said locking/release sleeve assembly overlapping the back of each of said fingertips when said fingertips mesh with said receptacle recesses, thereby giving locking engagement of said receptacle/plug assemblies;
  - (ii) said locking/release sleeve assembly being restrained from said overlapping movement, when said collet fingertips are outside of said receptacle recesses, by the rear of said fingertips;
  - (iii) having an inner annular channel for receiving a substantial amount of each of said collet shell balls and of a width such that the initial overlapping movement of said locking/release sleeve assembly stops with said balls still in the inner annular channel;
  - (iv) the length of said locking/release sleeve assembly providing a portion beyond the inner annular channel for covering said collet sleeve ball openings when said locking/release sleeve assembly reaches it farthest upward movement; and
  - (v) having trip ears for contacting tripping means;
- (c) a stayback sleeve assembly positioned inside of said collet shell having a stayback sleeve extending to said collet fingertips; and
  - (i) including spring means which urge the stayback sleeve toward said collet fingertips, and
  - (ii) said stayback sleeve is adapted for stop motion contact with the end of said receptacle barrel nearest said plug assembly;

(3) said plug assembly further including a capsule assembly comprising,
- (a) a plug contact insert for receiving electrical pin contacts for mating with receptacle electrical socket contacts; and (b) a plug contact shell fitting closely inside said plug housing
(i) for carrying said plug contact insert at one end;
(ii) providing access to the rear of said plug contact insert;
(iii) providing contact surface for a backshell cam assembly to move said capsule assembly into mated relation with said receptacle assembly; and
(iv) a plurality of spring cages positioned on the exterior of said plug contact shell so as to be compressed when said capsule assembly is moved into mated relation;

(4) said capsule assembly further including a receiver sleeve positioned closely inside said collet shell,
(a) having an outer annular channel for receiving a substantial width of said collet shell balls;
(b) positioned so that the outer annular channel is juxtaposed with said collet shell ball openings and with said locking/release sleeve assembly covering said collet sleeve ball openings, when the capsule assembly is moved to mated relation; and
(c) spring means for compression by said capsule assembly movement, for later imparting reverse movement to said receiver sleeve;

(5) a backshell cam assembly below said capsule assembly for movement of said capsule assembly into mated relation, said cam assembly including yieldable cam means to limit upward movement of said capsule assembly after the mated relation has been achieved; and (6) a mounting means to position and to maintain said plug housing on a support means.

2. The connector of claim 1 including, a visual/tactile indicator comprising:

a housing affixed to said plug housing, a retractable button, normally protruding outside said housing, terminating within said housing in a clevis attached to a ramp slot which ramp slot is fixed to said collet shell, whereby when said collet shell balls, the receiver sleeve annular channel, and the locking/release sleeve portion covering the collet shell ball openings are juxtaposed, the upward movement of the locking/release sleeve assembly causes said button to ride up the ramp slot and to retract said button inside the housing to indicate the connector is in mated relation.

3. The connector of claim 1 wherein said mounting means comprises:

a plurality of mounting post assemblies each comprising,
(a) a mounting ear extending from said plug housing, having an opening with at least one dished surface located about said opening;
(b) cone bushing member positioned in said dished opening;
(c) a rod member passing through said ear opening, with substantially compressively equal spring members on each side of said ear, and one of said spring members resting on said cone bushing member; and
(d) means for attaching said rod member to a support surface with each rod member being attached at a corresponding end to said surface.

4. The connector of claim 1 wherein said receptacle assembly orientation means consists of a plurality of orientation keys positioned on the exterior surface of said receptacle barrel.

5. The connector of claim 4 wherein said collet shell orientation means consists of a plurality of orientation fan-shaped recesses positioned in an annular inclined inner surface extending from the outer edge of said collet guide ring, for locating corresponding receptacle keys, and keyways at the base of each of said fans for receiving said receptacle keys.

6. The connector of claim 1 wherein said yieldable cam means consist essentially of a cam having a semi-circular camming edge and an ogive shaped other camming edge, and said ogive having a wheel rotatable mounted thereon with the wheel edge extending closely beyond the ogive affording a yielding cam surface when the wheel is in contact with capsule assembly.

* * * * *